US007389602B1

(12) United States Patent
Simoes

(10) Patent No.: US 7,389,602 B1
(45) Date of Patent: Jun. 24, 2008

(54) HANDICAP PLACARD DASH DISPLAY

(76) Inventor: Anthony Simoes, 1604 McDonald Rd., NW., Albuquerque, NM (US) 87107

( * ) Notice: Subject to any disclaimer, the term of this patent is extended or adjusted under 35 U.S.C. 154(b) by 1315 days.

(21) Appl. No.: 10/194,729

(22) Filed: Jul. 10, 2002

Related U.S. Application Data

(60) Provisional application No. 60/304,838, filed on Jul. 11, 2001.

(51) Int. Cl.
*G09F 21/04* (2006.01)

(52) U.S. Cl. ..... 40/593; 40/643

(58) Field of Classification Search ..... 40/593, 40/594, 611.13, 124.09, 124.18, 124.14, 40/643, 644, 661.08, 672
See application file for complete search history.

(56) References Cited

U.S. PATENT DOCUMENTS

| | | | | |
|---|---|---|---|---|
| 993,674 | A * | 5/1911 | Freeman | 40/611 |
| 1,697,700 | A | 1/1929 | Tucker et al. | |
| 1,733,293 | A | 10/1929 | Brow | |
| 2,278,076 | A * | 3/1942 | Horr | 40/124.18 |
| 2,611,572 | A * | 9/1952 | Rocca | 40/124.18 X |
| 2,990,637 | A | 7/1961 | Saben | |
| 3,471,958 | A | 10/1969 | Westin | |
| 3,531,880 | A | 10/1970 | Ramee | |
| 3,936,967 | A | 2/1976 | Davis | |
| 4,069,606 | A | 1/1978 | Shevin et al. | |
| 4,132,022 | A | 1/1979 | Wood, Jr. | |
| 4,270,292 | A | 6/1981 | Eckberg, II | 40/611 |
| 4,756,106 | A | 7/1988 | Foster | 40/591 |
| 4,954,083 | A | 9/1990 | Leff et al. | |
| 5,069,376 | A | 12/1991 | Barel | |
| 5,387,010 | A * | 2/1995 | Mohr | 40/593 X |
| 5,818,642 | A | 10/1998 | Collette | |
| 6,112,443 | A | 9/2000 | Stubbs | 40/591 |
| 6,276,081 | B1 * | 8/2001 | Shedd | 40/593 |
| 6,430,854 | B1 * | 8/2002 | Szentgyorgyi et al. | 40/593 |

* cited by examiner

*Primary Examiner*—Joanne Silbermann
(74) *Attorney, Agent, or Firm*—Peacock Myers, P.C.; Jeffrey D. Myers; Vidal A. Oaxaca

(57) ABSTRACT

A handicap placard holder and method of use comprising a display surface for the placard, triangular side panels on sides of the display surface and bent at an angle from the display surface, means for holding the placard in place on the display surface, and means for attaching the holder to a dash of a motor vehicle.

17 Claims, 4 Drawing Sheets

HANDICAP PLACARD DASH DISPLAY

CROSS-REFERENCE TO RELATED APPLICATIONS

This application claims the benefit of the filing of U.S. Provisional Patent Application Ser. No. 60/304,838, entitled "Motor Vehicle Accessory Specifically Designed to Hold a Handicap Placard in View", filed on Jul. 11, 2001, and the specification thereof is incorporated herein by reference.

BACKGROUND OF THE INVENTION

1. Field of the Invention (Technical Field)

The present invention relates to apparatuses and methods for displaying handicap placards in motor vehicles.

2. Background Art

As the importance of access for physically challenged individuals has increased, and with recent increases in the population of the elderly, the use of handicap placard in motor vehicles has also increased. Typically, because placards tend to slide around on a dashboard if displayed there while a vehicle is moving, individuals clip their placards to a sun visor, store them in a dash slot, or store them in the glove compartment while the vehicle is in motion. They then need to bring them out and place them on the dash when parked in a handicap parking stall.

Related technologies are disclosed in U.S. Pat. No. 6,112,443, to Stubbs, entitled "Emergency Signalling Apparatus and Method"; U.S. Pat. No. 5,818,642, to Collette, entitled "Message-Reflecting Apparatus and Method of Use"; U.S. Pat. No. 5,069,376, to Barel, entitled "Motor Vehicle Accessory Particularly Useful for Holding a Sign or Other Article"; U.S. Pat. No. 4,954,083, to Leff et al., entitled "Communication Aid"; U.S. Pat. No. 4,132,022, to Wood, Jr., entitled "Reflected Sign"; U.S. Pat. No. 4,756,106, entitled "Vehicle Message Holder"; U.S. Pat. No. 4,270,292, to Eckberg, II, entitled "Sign With Changeable Inserts"; U.S. Pat. No. 4,069,606, to Shevin et al., entitled "Display Card Holder"; U.S. Pat. No. 3,936,967, to Davis, entitled "Emergency Sign Device"; U.S. Pat. No. 3,531,880, to Ramee, entitled "Combination Identification Display and Gate Key Card"; U.S. Pat. No. 3,471,958, to Westin, entitled "Vehicle Advertising Device"; U.S. Pat. No. 2,990,637, to Saben, entitled "Mirror-Mounted Auxiliary Object Holder"; U.S. Pat. No. 1,733,293, to Brow, entitled "Map Support for Motorists"; and U.S. Pat. No. 1,697,700, to Tucker et al., entitled "Card Holder for Automobiles".

However, no existing device provides the features of simplicity and reliability provided by the present invention.

SUMMARY OF THE INVENTION

Disclosure of the Invention

The present invention is of a handicap placard holder comprising: a display surface for the placard; triangular side panels on sides of the display surface and bent at an angle from the display surface; means for holding the placard in place on the display surface; and means for attaching the holder to a dash of a motor vehicle. In the preferred embodiment, the triangular side panels are bent at less than a 90 degree angle from the display surface, the holding means comprises a plurality of tabs on the display surface (with preferably a tab at the lower end of the display surface being elongated), and the attaching means comprises a section of hook-and-loop fasteners adhered to the bottom of the lower end of the holder. Alternatively or additionally the attaching means comprises a lip formed at the lower end of the display surface.

The invention is also of a display holder for a dash of a motor vehicle, comprising: a display surface for matter to be displayed on the dash; triangular side panels on sides of the display surface and bent at an angle from the display surface; means for holding the matter to be displayed in place on the display surface; and means for attaching the holder to the dash. In the preferred embodiment, the triangular side panels are bent at less than a 90 degree angle from the display surface, the holding means comprises a plurality of tabs on the display surface (preferably with a tab at the lower end of the display surface being elongated), and the attaching means comprises a section of hook-and-loop fasteners adhered to the bottom of the lower end of the holder. Alternatively or additionally the attaching means comprises a lip formed at a lower end of the display surface. The matter to be displayed is preferably a handicap placard.

The invention is further of a method for displaying matter in a holder on a dash of a motor vehicle, comprising: providing a display surface for matter to be displayed on the dash; deploying triangular side panels on sides of the display surface and bent at an angle from the display surface; holding the matter to be displayed in place on the display surface; and attaching the holder to the dash. In the preferred embodiment, the triangular side panels are bent at less than a 90 degree angle from the display surface, the holding step comprises employing a plurality of tabs (preferably with a tab at the lower end of the display surface being elongated), and the attaching step comprises employing a section of hook-and-loop fasteners adhered to the bottom of the lower end of the holder. Additionally or alternatively the attaching step comprises employing a lip formed at a lower end of the display surface. The matter to be displayed is preferably a handicap placard.

A primary object of the present invention is to provide a holder for handicap placards to be displayed on the dash of a motor vehicle.

A primary advantage of the present invention is that sliding of the holder is prevented.

Another advantage of the present invention is that the handicap placard can be readily removed from the holder if it is desired not to display it.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DESCRIPTION OF THE PREFERRED EMBODIMENTS

Best Modes for Carrying Out the Invention

The present invention is of a motor vehicle accessory (holder) specifically designed to display a handicap placard. The invention displays the placard on the dash of any motor vehicle without obstructing the view of the driver or being prone to sliding around. The invention is preferably secured to the dash via strips of hook-and-loop connectors (e.g., Velcro® strips, a product of Minnesota Mining and Manufacturing ("3M") Company). While it is preferred for use with handicap placards, the invention can be used with other matter to be displayed, including parking permits, park passes, advertising, and like matter.

The invention can also be placed on a back dash facing the rear window of an automobile. This is particularly useful when parked in a parking garage or otherwise facing a wall.

Figure 1:
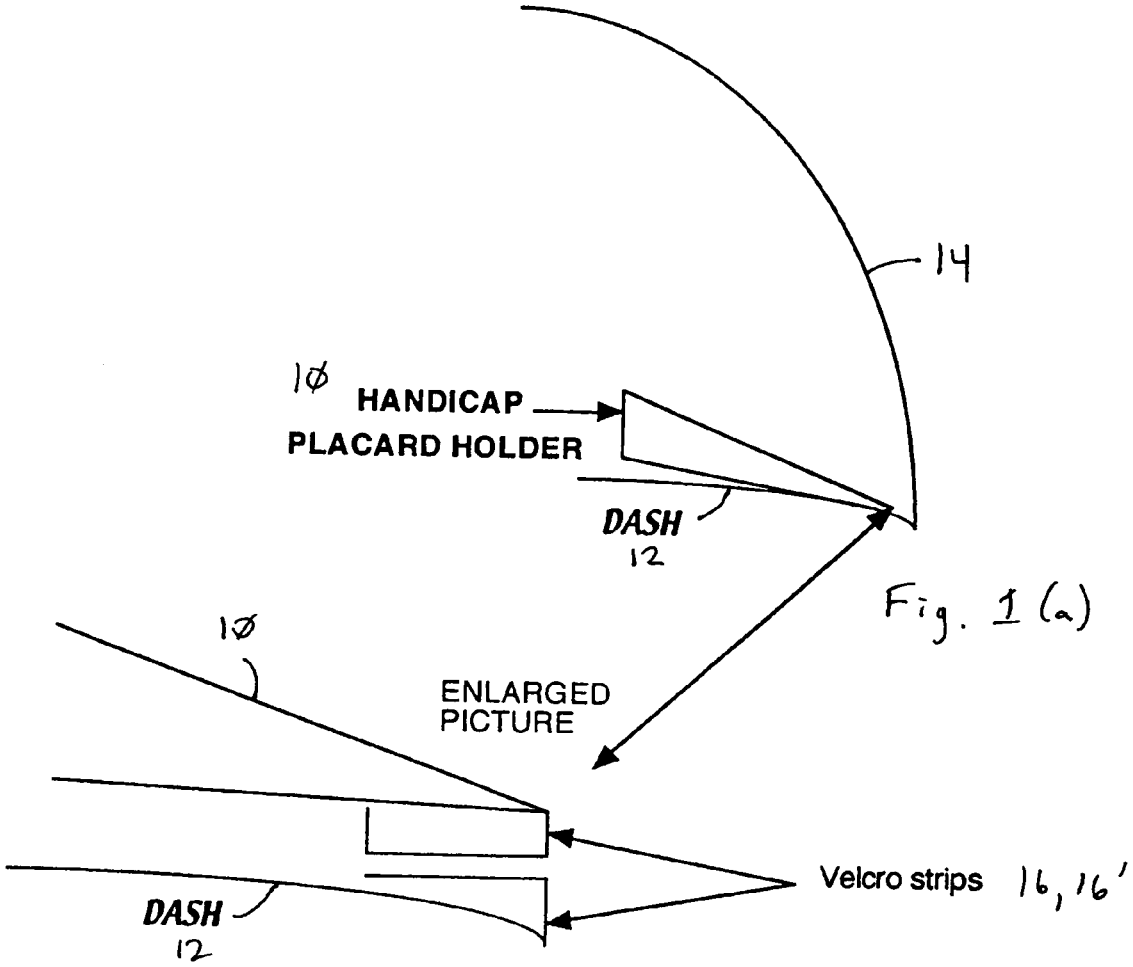
FIGS. 1(*a*) and 1(*b*) are side views of the placard holder of the invention attached to a dash of a motor vehicle.

FIG. 1(*a*) shows the holder 10 of the invention installed on a dash 12 of a motor vehicle beneath windscreen 14. FIG. 1(*b*) shows the holder attached to the dash via preferred hook-and-loop fastener sections 16,16' adhered to the holder and the dash.

Figure 2:
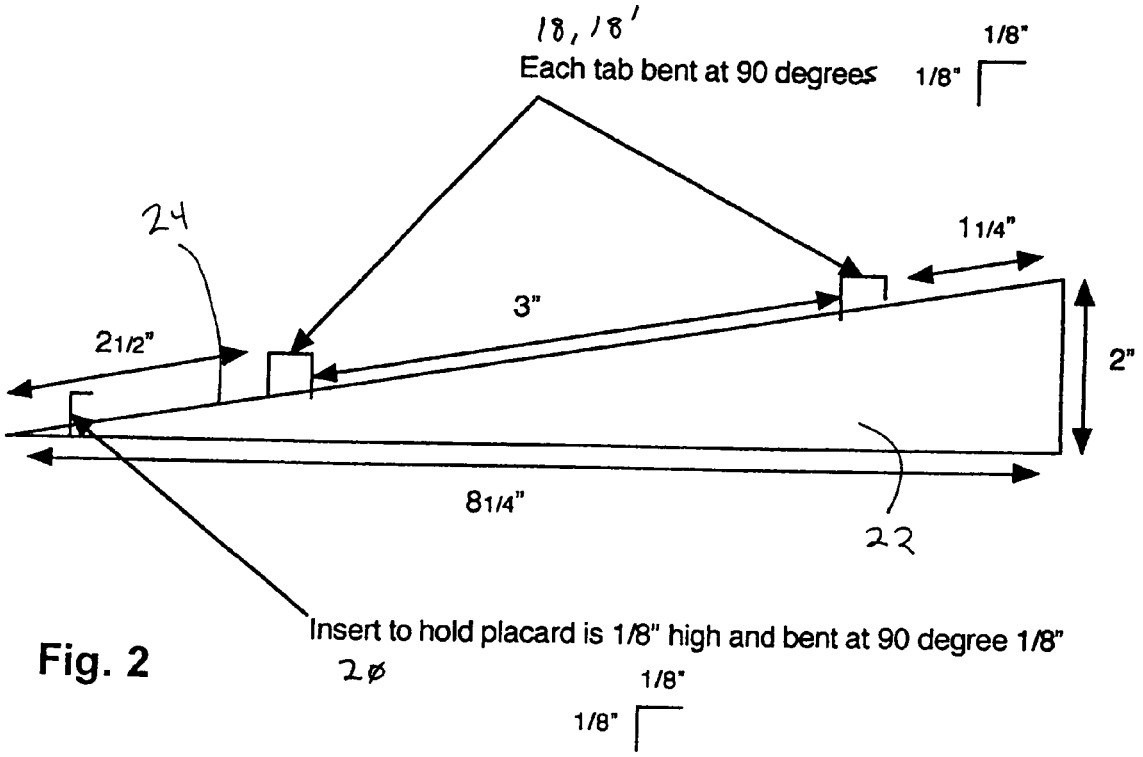
FIG. 2 is a side view of the placard holder ready for deployment.

FIG. 2 shows the holder in side view as assembled, with triangular side panel 22, display surface 24, tabs 18,18', and elongated tab 20. The tabs keep the placard in place, preferably loosely so that insertion and extraction are not difficult. Alternatively, other attachment means are possible, such as hook-and-loop fastener sections adhered to the display surface and to the back of the placard, clips formed on the display surface, and the like. Preferred dimensions are shown which are appropriate to handicap placards as issued by many states of the United State of America. Dimensions should be adjusted as appropriate to the matter to be displayed. Alternatively, a clear plastic sleeve (not shown) appropriately sized may be employed to hold placards of varying sizes in place on the holder.

Figure 3:
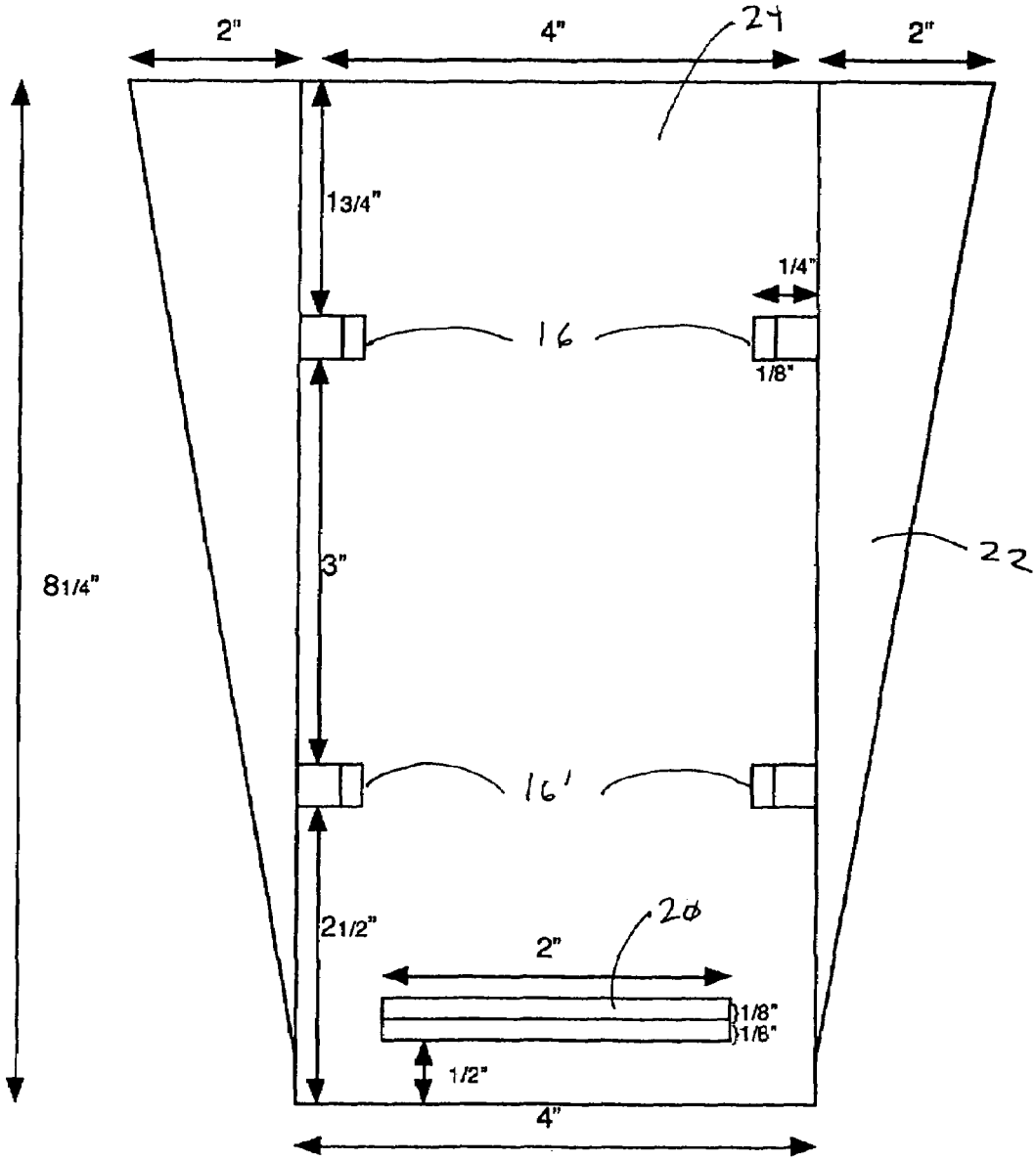
FIG. 3 is a top perspective view of the placard holder ready for deployment.

FIG. 3 shows the holder in top view prior to assembly, again with preferred dimensions.

Figure 4:
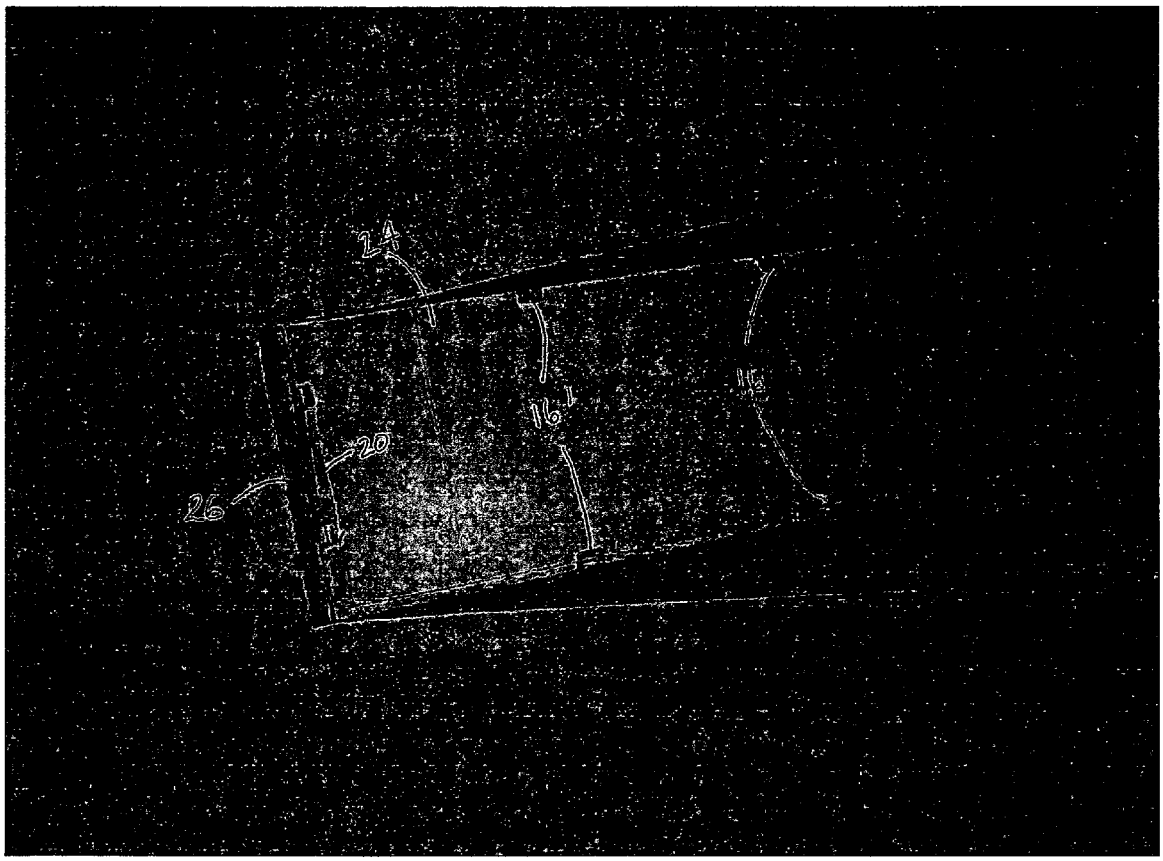
FIG. 4 is a top view of the placard holder prior to pop-outs and folding of tabs and flaps.

FIG. 4 shows the holder in top perspective view. Note that the sides are preferably folded at less than a 90 degree angle from the display surface, which increases the stability of the holder on a vehicle's dash. The holder is shown with optional lip 26 which is folded at an angle from the display surface and which is designed to hook over the lip of a dash where the dash meets the windscreen.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A handicap placard holder comprising:

a display surface for the placard;

triangular side panels on sides of said display surface and bent at an angle from said display surface;

means for holding the placard in place on said display surface;

means for attaching the holder to a dash of a motor vehicle and a plurality of tabs on said display surface, said placard holder having a sufficiently short height such that visibility of text and graphics on said placard is maintained while maximizing an unobstructed surface area of said vehicle's windshield.

2. The holder of claim 1 wherein said triangular side panels are bent at less than a 90 degree angle from said display surface.

3. The holder of claim 1 wherein a tab at a lower end of said display surface is elongated.

4. The holder of claim 1 wherein said attaching means comprises a section of hook-and-loop fasteners adhered to a bottom of a lower end of the holder.

5. The holder of claim 1 wherein said attaching means comprises a lip formed at a lower end of said display surface.

6. A display holder for a dash of a motor vehicle, the holder comprising:

a display surface for matter to be displayed on the dash;

triangular side panels on sides of said display surface and bent at an angle from said display surface;

means for holding the matter to be displayed in place on said display surface;

means for attaching the holder to the dash, and a plurality of tabs on said display surface, said display holder having a sufficiently small height visibility of text and graphics on said display is maintained while maximizing an unobstructed surface area of said vehicle's windshield.

7. The holder of claim 6 wherein said triangular side panels are bent at less than a 90 degree angle from said display surface.

8. The holder of claim 6 wherein a tab at a lower end of said display surface is elongated.

9. The holder of claim 6 wherein said attaching means comprises a section of hook-and-loop fasteners adhered to a bottom of a lower end of the holder.

10. The holder of claim 6 wherein said attaching means comprises a lip formed at a lower end of said display surface.

11. The holder of claim 6 wherein the matter to be displayed is a handicap placard.

12. A method for displaying matter in a holder on a dash of a motor vehicle, the method comprising the steps of:

providing a display surface for matter to be displayed on the dash;

deploying triangular side panels on sides of the display surface and bent at an angle from the display surface, the triangular side panels having sufficiently small height such that a visibility of text and graphics on the display surface is maintained while maximizing an unobstructed surface area of said vehicle's windshield;

providing a plurality of tabs for holding the matter to be displayed in place on the display surface; and attaching the holder to the dash.

13. The method of claim 12 wherein in the deploying step the triangular side panels are bent at less than a 90 degree angle from the display surface.

14. The method of claim 12 wherein in the holding step a tab at a lower end of the display surface is elongated.

15. The method of claim 12 wherein the attaching step comprises employing a section of hook-and-loop fasteners adhered to a bottom of a lower end of the holder.

16. The method of claim 12 wherein the attaching step comprises employing a lip formed at a lower end of the display surface.

17. The method of claim 12 wherein the matter to be displayed is a handicap placard.

* * * * *